United States Patent [19]

Morita et al.

[11] Patent Number: 4,709,222

[45] Date of Patent: Nov. 24, 1987

[54] FUSE DEVICE

[75] Inventors: Shigeru Morita; Yukio Sugaya, both of Yokohama, Japan

[73] Assignee: Kabushiki Kaisha S.K.K., Kanagawa, Japan

[21] Appl. No.: 23,703

[22] Filed: Mar. 9, 1987

Related U.S. Application Data

[63] Continuation of Ser. No. 762,621, Aug. 5, 1985, abandoned.

[30] Foreign Application Priority Data

Aug. 6, 1984 [JP] Japan ..... 59-163815

[51] Int. Cl.[4] ..... H01H 85/38; H01H 85/18

[52] U.S. Cl. ..... 337/273; 337/276

[58] Field of Search ..... 337/273, 276

[56] References Cited

U.S. PATENT DOCUMENTS 1,097,964 5/1914 Banks ..... 337/276

3,838,375 9/1974 Frind et al. ..... 337/276

*Primary Examiner*—Harold Broome

*Attorney, Agent, or Firm*—Kane, Dalsimer, Kane, Sullivan and Kurucz

[57] ABSTRACT

A fuse device comprises a casing, a fuse element accommodated in the casing and an arc-extinguishing agent accommodated in the casing and consisting of a fibrous or powdery non-conductive material.

1 Claim, 1 Drawing Figure

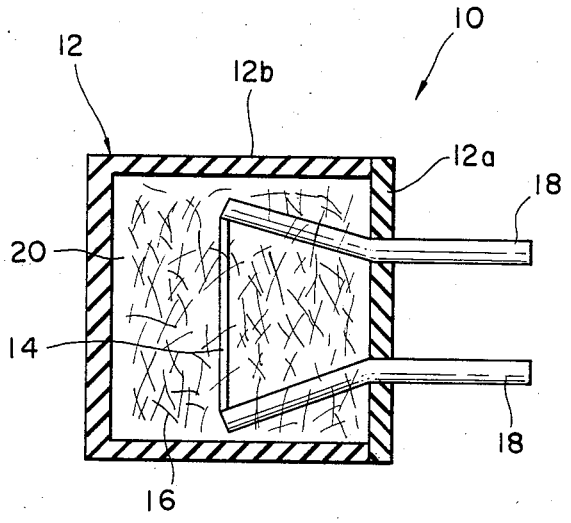
10
12
12b
12a
18
20
14
18
16

FUSE DEVICE

This is a continuation of co-pending application Ser. No. 762,621 filed on Aug. 5, 1985, abandoned.

BACKGROUND OF THE INVENTION

1. Field of the Invention:

This invention relates to a fuse device for cutting off an overcurrent and, more particularly, to a fuse device, in which a fuse element is accommodated together with an arc-extinguishing agent in a casing.

2. Description of the Prior Art:

In a fuse device, in which a fuse element consisting of a fusible metallic material is accommodated in a casing, the temperature inside the casing is locally elevated, although momentarily, to several thousand degrees by an arc current that is caused when the fuse element is broken apart. In this case, it is liable that the casing is destroyed explosively due to an increase in the inner gas pressure, and such an explosion will cause a fire.

In order to prevent the explosion of the casing at the time of the breaking of the fuse element as noted above, it is tried to seal silica gel particles as arc-extinguishing agent in the casing in case of a largesize large-capacity fuse device with a rated current of several hundred amperes used for a power source apparatus of electric cars. The silica gel particles accommodated as the arc-extinguishing agent together with the fuse element in the casing, is partly fused by the heat generated at the time of the breaking of the fuse element, thus absorbing the arc heat.

However, the prior art arc-extinguishing agent noted above is in the form of particles, so that is leaves continuous interstices among the particles. Therefore, when the fuse element is fused by an overcurrent, its fused portion will not be dispersed into intimate contact with individual particles but remain in inter-particle interstices. In such a case, the arc-extinguishing agent consisting of the silica gel particles is not be contacted by the fused portion of the fuse element over a sufficiently broad area so that it is not fused sufficiently. That is, it can not absorb the arc heat effectively. In addition, the fused portion of the fuse element that is not dispersed sufficiently but is collected in the inter-particle interstices, is liable to form a current short-circuit path by being fusedly attached to particles in the inter-particle interstices. In this case, the function of the fuse device is lost.

In a further aspect, in a small size fuse device with a rated current of several amperes or below, the fuse element consists of a small diameter filament which can be readily broken apart by a physical force. Therefore, in the manufacture of the fuse device the fuse element is liable to be given damage by the silica gel particles that are accommodated as the arc-extinguishing agent in the casing.

SUMMARY OF THE INVENTION

An object of the present invention, accordingly, is to provide a fuse device having superior safety and operational reliability, with which a fuse element will not be given damage during its manufacture, and which can effectively absorb the arc heat at the time of the breaking of the fuse element to reliably prevent rupture of the casing as well as reliably cutting off an overcurrent.

A fuse device according to the present invention is characterized in that a fibrous or powdery nonconductive material is accommodated as an arc-extinguishing agent in a casing accommodating a fuse element.

According to the present invention, the arc-extinguishing agent consists of a fibrous or powdery non-conductive material. Therefore, even if the fuse element consists of a small diameter filament capable of being readily broken apart and is accommodated in the casing before or after the disposition of the arc-extinguishing agent in the casing, it will not be given damage as in the prior art by the arc-extinguishing agent accommodated in the casing. That is, it is possible to eliminate damage to the fuse element caused by the arc-extinguishing agent during the manufacture of the fuse device.

Further, when the fuse element is fused by an overcurrent, the arc-extinguishing agent consisting of the fibrous or powdery non-conductive material permits sufficient dispersion of the fused portion of the fuse element such that no short-circuit path will be formed by the fused portion and that it is contacted by the fused portion over a broad area compared to the prior art and thus be reliably fused to effectively absorb the arc heat and hence effectively suppress temperature rise of the inside of the casing, thus reliably preventing the increase of the pressure in the casing.

Thus, according to the present invention it is possible to eliminate damage to the fuse element during manufacture of the fuse device and also reliably prevent overheating and explosion of the casing that might otherwise be caused by an arc current at the time of the breaking of the fuse element and also a possible fire due to such an explosion of the casing.

The features of the present invention will become more apparent from the followng detailed description taken in conjunction with the drawing which indicates an embodiment of the invention.

BRIEF DESCRIPTION OF THE DRAWING

The FIGURE is a cross-sectional view showing a fuse device according to the present invention.

DESCRIPTION OF THE PREFERRED EMBODIMENT

The FIGURE shows a fuse device 10 according to the present invention. As is shown, the fuse device 10 comprises a casing 12, a fuse element 14 and arc-extinguishing agent 16. The illustrated embodiment of the fuse device 10 is a so-called microfuse of a small size, for instance with a rated voltage of 125 V, a rated current of 63 mA to 5A and a breaking current of 50A.

The casing 12 may be made of well-known non-conductive synthetic resin material having heat resistance and high mechanical strength. The casing is desirably made of a material having a self-extinguishing property, for instance composed of polycarbonate and glass. In the illustrated embodiment, the casing 12 is a sealed casing comprising a circular base 12*a*, which is penetrated by a pair of electrode pins 18, and a cylindrical cap 12*b*, which defines a sealed chamber 20 cooperating with the base 12*a*.

The portions of the pair electrode pins 18 extending into the chamber 20 are spaced apart by gradually increasing distance toward their ends. The fuse element 14 is disposed in the chamber 20 such that it is spaced apart from the inner walls of the chamber 20. The ends of the fuse element 14 are welded to the respective ends of the pair electrode pins 18.

The arc-extinguishing agent 16 is disposed in the chamber 20 such that it surrounds the fuse element 14.

The arc-extinguishing agent 16 consists of a fibrous non-conductive material. An example of the non-conductive material is a mixture of silicon and alumina. The arc-extinguishing agent may be prepared by fusing a mixture material consisting of a ceramic material mainly composed of silicon and alumina using a solvent or directly fusing the mixture material by overheat and then hardening the fused mixture material into a fibrous form. The firbrous arc extinguishing agent 16 can be formed only by the ceramic material, however the silicon in the ceramic material noted above has a melting point of approximately 1,740° C., while alumina has a higher melting point i.e., approximately 2,040° C. Therefore, a mixture of these two materials is desirably used to obtain a higher melting point of the arc-extinguishing agent 16. In this case, the percent by weight of the ceramic material is desirably smaller than the percent by weight of the alumina. Further, the arc-extinguishing agent desirably has a crystalline structure.

The fuse device 10 having the structure described above is assembled by filling the cap 12*b* of the casing 12 with a predetermined quantity of arc-extinguishing agent 16 and then hermetically securing the base 12*a*, to which the fuse element 14 is coupled via the pair electrode pins 18, to the open end of the cap 12*b* such that the fuse element 14 is located within the arc-extinguishing agent 16.

The fibrous arc-extinguishing agent 16 disposed in the cap 12*b*, may be partly rendered into a powdery form by temporarily urging it against the bottom of the cap 12*b*.

Since the arc-extinguishing agent 16 is fibrous, it has sufficient capability of deformation. Therefore, even if the fuse element 14 of the fuse device 10 consists of a small diameter filament member that can be readily broken apart, it will never be given damage as in the prior art by the arc-extinguishing agent 16. It is thus possible to eliminate damage to the fuse element by the arc-extinguishing agent during the manufacture of the fuse device.

Further, since the fibrous arc-extinguishing agent 16 surrounds the fuse element 14 so as to define complicated gaps therearound, when the fuse element 14 is fused by an overcurrent the fused portion thereof is reliably dispersed in the interstices among the fibrous pieces of the arc-extinguishing agent 16. The fused portion of the fuse element 14 thus will never form a current short-circuit path between the pair electrode pins 18 that would result in the case of the prior art.

Further, the used portion of the fuse element 14 noted above, which is dispersed in the interstices among fibrous pieces of the arc-extinguishing agent 16, is in contact with the arc-extinguishing agent over a broad area compared to the case of the prior art, and the arc-extinguishing agent 16 in the fibrous form is more readily fusible than in the form of particles. Therefore, portion of the arc-extinguishing agent 16 that is in contact with the fused portion of the fuse element is reliably fused. Thus, part of the arc heat generated by the arc current produced when the fuse element 14 is broken apart, is effectively absorbed as heat of fusion of the arc-extinguishing agent 16. It is thus possible to effectively suppress temperature rise of the casing 12 due to the arc heat, thus reliably eliminating the overheating and explosion of the casing 12 and fire accident due to such explosion of the casing.

The ceramic fiber as the arc-extinguishing agent 16 is advantageously composed, as a main component, of such a high-melting material as steatite, zircon or titanium oxide in addition to alumina as noted above. Further, it is possible to use fibrous materials consisting of electrically insulating materials such as asbestos, glass, etc. Further, it is possible to use a powdery non-conductive material as the arc-extinguishing agent 16. Still further, a fibrous non-conductive material may be used in the form of a felt.

Further, while the above embodiment has concerned with a microfuse with a sealed casing, the casing may be other than the sealed casing. Moreover, the present invention is applicable to a large-size large-capacity fuse device with a rated current of several hundred amperes.

What is claimed is:

1. A fuse device comprising:

a casing of a nonconductive material having a base portion and a cap portion to define a chamber in cooperation with the base portion;

a pair of electrode pins penetrating said base portion and projecting outward from the inside of said casing;

a fuse element accommodated in said casing and electrically connecting each other the sides of the portions inside said casing of said electrode pins; and an arc-extinguishing agent accommodated in said casing and consisting of a fibrous or powdery non-conductive material, said arc-extinguishing agent being obtained by overheating a mixture of ceramic and alumina to fuse same directly or by solvent, said ceramic being mainly of silicon, and by solidifying the fused mixture into fibrous state, in which the percent by weight of said ceramic is smaller than that of said alumina.

* * * * *